6/17/86 XR 4,594,899

United States Patent [19]

Henke et al.

[11] Patent Number: 4,594,899

[45] Date of Patent: Jun. 17, 1986

[54] METHOD AND APPARATUS FOR TESTING SOIL

[76] Inventors: Robert Henke; Wanda K. Henke, both of 13610 Pinerock, Houston, Tex. 77079

[21] Appl. No.: 586,799

[22] Filed: Mar. 6, 1984

[51] Int. Cl.[4] ..... G01N 3/00; G01N 3/32

[52] U.S. Cl. ..... 73/784; 73/151

[58] Field of Search ..... 73/784, 84, 841, 151, 73/59

[56] References Cited

U.S. PATENT DOCUMENTS

| | | | |
|---|---|---|---|
| 2,303,162 | 11/1942 | Godwin et al. | 73/60 |
| 2,603,967 | 7/1952 | Carlson . | |
| 2,709,363 | 5/1955 | Lea . | |
| 3,435,666 | 4/1969 | Fann . | |
| 3,465,576 | 9/1969 | Spanski . | |
| 3,561,259 | 2/1971 | Barendse . | |
| 3,643,498 | 2/1972 | Hardin . | |
| 3,709,031 | 1/1973 | Wilson et al. . | |
| 4,274,283 | 1/1981 | Maus et al. . | |
| 4,302,967 | 12/1981 | Dufey . | |
| 4,353,247 | 10/1982 | De Domenico . | |

FOREIGN PATENT DOCUMENTS

| | | | |
|---|---|---|---|
| 586369 | 9/1977 | U.S.S.R. | 73/60 |
| 616561 | 9/1978 | U.S.S.R. | 73/60 |

OTHER PUBLICATIONS

"Nonlinear Torsional Dynamic Response of Footing", by Robert Henke et al., Journal of Geotechnical Engineering, vol. 109, No. 1, Jan. 1983.

"Seismic Techniques in the Laboratory", by R. D. Woods and Robert Henke, Geophysical Methods in Geotechnical Engineering; ASCE National Convention, Oct. 23–25, 1979.

"Development of a Bottom-Hole Device for Offshore Shear Wave Velocity Measurement", by K. H. Stokoe, II et al., Offshore Technology Conference, OTC 3210, 1978.

"Borehole Shear Device Feasibility and Preliminary Studies", by Dames and Moore, Aug. 1980.

*Primary Examiner*—Anthony V. Ciarlante

*Attorney, Agent, or Firm*—Arnold, White & Durkee

[57] ABSTRACT

A method and apparatus for testing soil involves a probe with an inner cylinder insertable into the sample to be tested and rotatable through a limited arc of rotation. The inner cylinder may be rotated by an impulse, from an initial condition or by an oscillatory motion. An outer cylinder may be provided concentric to the inner cylinder and spaced therefrom to facilitate the measurement of liquefaction resistance and soil degradation. A motion sensor mounted on the inner cylinder enables the recording of the response of the cylinder and the soil to a particular rotary excitation. A shield may be provided about the upper end of the inner cylinder in order to allow measurements to be obtained from a region sufficiently below the surface of the soil so as to be relatively free from surface effects. A surface compression unit may be provided between the inner and outer cylinders which is operable to supply a pressure to compensate for the loss of overburden in downhole applications. The surface compression unit may also apply a rotating shear force to smooth the soil surface so that the pressure applied by the unit is uniform.

35 Claims, 8 Drawing Figures

Fig. 4a
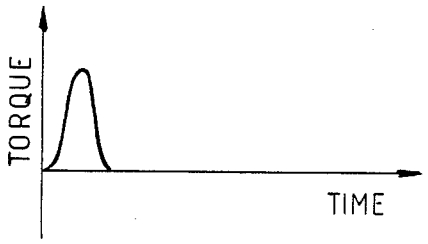
Fig. 4b
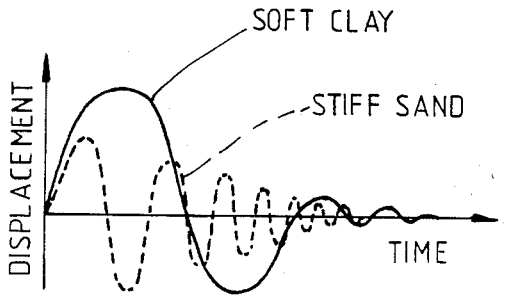
Fig. 4c
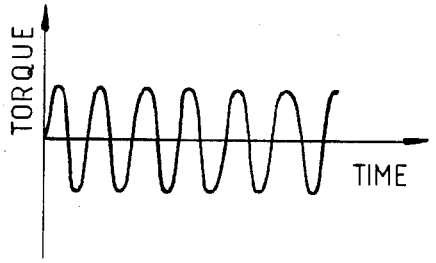
Fig. 4d
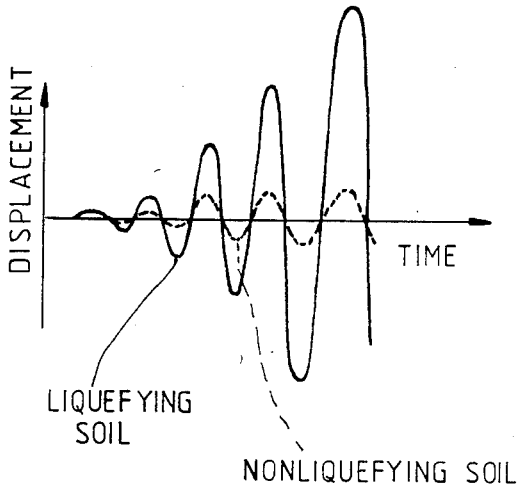
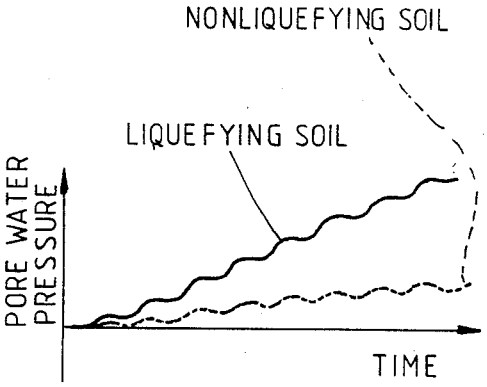
Fig. 4e

METHOD AND APPARATUS FOR TESTING SOIL

BACKGROUND OF THE INVENTION

1. Field of the Invention

This invention relates generally to techniques for testing soils, and particularly to techniques for testing soils involving the application of disturbances to an object embedded in the soil to evaluate the response of the object and the soil to such loading.

2. Background Art

It is often important to determine, at least by estimate, the resistance of a soil to liquefaction, the degradation characteristics of a soil, the dynamic shear modulus of a soil at low levels of shear deformation and the variation in the dynamic shear modulus of a soil with shear deformation. Liquefaction is the total loss of the stiffness and strength of a saturated soil, caused by increased pore water pressure which can result from cyclic loading. Degradation is the reduction in stiffness also due to the buildup of pore water pressure caused by cyclic loading. Degradation may or may not lead to liquefaction depending on the type and state of the soil. The shear modulus is basically the shearing stiffness of a soil. Generally, the shear modulus of a soil is a function of shearing deformation. For example, most soils show reduced stiffness with increasing deformation under monotonically increasing loading.

Commonly these properties are necessary for analyses which predict the response of a site or foundation-structure system to dynamic loading caused by earthquakes, ocean waves or mechanical vibrations. Conventionally, these properties have been determined by conducting laboratory tests on samples recovered from a site or by in situ field tests.

Laboratory testing of soil samples suffers from a number of problems. Particularly, the acts of recovering a sample, transporting it to a laboratory and preparing the sample for a test, can so disturb a sample from its original state, as to bring to question any results obtained. In addition, it is often difficult to reproduce the original field environment (state of stress) of the sample because it is often difficult and costly to define the environment and because typical laboratory test apparatus are limited in their ability to reproduce environmental conditions. Because of the failure to precisely account for environmental considerations, laboratory tests are subject to error for this additional reason. Safely accounting for these disturbances and for environmental conditions may lead to excessively costly structures.

The field testing of soils also suffers from a number of problems. Liquefaction resistance is generally tested in the field by a penetration test. Conventionally, a closed ended probe is either penetrated into the ground at a controlled slow rate, simulating static, non-cyclic loading but introducing severe failure into the local soil, or a cylinder is driven into the ground by violent impacts, also causing severe and immediate failure in the soil local to the cylinder. The resistance of the soil to liquefaction is correlated to the resistance of the probe or cylinder to penetration. Neither of these tests induces the type of loading generally induced by earthquakes or ocean waves which are the main known causes of liquefaction.

Generally, earthquakes and ocean waves generate a lower amplitude loading which does not produce the magnitude of stresses needed for severe, immediate failure. Rather, the soil is excited at a lower amplitude of stress for a number of cycles. Generally, each cycle causes the soil to degrade incrementally and liquefaction is achieved only after a number of cycles. Hence, the phenomena induced by penetration tests are different from those of real interest, bringing into question the validity of the correlation of liquefaction resistance to penetration resistance.

The fact that the desired loadings are not reproduced in penetration tests leads to other problems. For example, a number of common factors, such as age, state of stress, stress history, and the like, affect significantly liquefaction resistance as well as the resistance of an object to penetration. However, it is unlikely that these factors affect liquefaction resistance to the same degree that they affect the resistance to penetration. This brings into further question the validity of a correlation between liquefaction resistance and penetration resistance. As a result of such uncertainties, widely used correlations between liquefaction and penetration resistance are deliberately very conservative and can lead to costly designs for major structures.

In addition, correlations are not available for all of the different types of soils which may be prone to liquefaction. Thus, there is even a greater uncertainty in estimating liquefaction resistance from penetration test results for a site consisting of soils with no significant testing history. A further drawback to in situ penetration testing is that this type of testing does not readily provide the type of information needed to conduct the refined analyses which are often necessary for site and foundation response studies.

While in situ testing procedures have not been widely used to obtain degradation characteristics, a number of in situ tests have been used to determine the dynamic shear modulus and to a lesser extent, its variation with shear deformation. These include wave propagation tests, resonant footing tests and downhole probe tests. There are several different wave propagation techniques. With these techniques, the shear modulus of the soil is estimated from the measurement of some wave parameter, such as wave speed or wavelength. Each of these techniques has limitations or drawbacks. One technique, known as "seismic crosshole testing", requires two or more bore holes with sensors, and a below ground excitation source, making it relatively expensive for testing in a normal environment and difficult to practice in an offshore environment. A second technique, known as "seismic downhole testing", requires only one bore hole but is limited to measurements involving very low strain amplitude. A third technique, known as "seismic refraction", can result in poor definition of layering for sites where interbedded layers exist. A fourth technique, involving surface wave generation, requires sizeable equipment to provide definition of layering to the depths typically of interest.

In resonant footing tests for obtaining dynamic shear modulus, a footing located at the surface is vibrated to determine its resonant frequency. With this procedure, only the near surface shear modulus can be estimated. It is usually desirable, however, to also obtain the below surface characteristics.

There are several downhole probes for measuring shear modulus. One probe measures the shear modulus of the walls of a bore hole. The material along the bore hole wall can be very disturbed due to the drilling activity, and may give results that are not representative of undisturbed soil. It is believed that with this technique, difficulties would be experienced in taking measurements in a cased bore hole. A second probe, disclosed in U.S. Pat. No. 3,643,498 to Hardin, has similar capabilities and potential problems. Additionally, this probe may be penetrated below the base of the bore hole but this device probably would displace a considerable amount of the soil in the immediate vicinity of the measurement. Thus, the zone of soil having the greatest influence on measurements would probably be highly disturbed and therefore, to some degree, unrepresentative of the undisturbed soil.

While the state of the technology in this field has experienced rapid advancement, and many of the techniques now known have important advantages, the inventor of the present invention has identified certain characteristics that would be particularly advantageous if implemented in a single device. These characteristics include minimal soil disturbance by the testing probe, preservation of the original environment of the test soil, in situ testing using loading comparable to that experienced during the real life phenomena that induce soil failure, and the capability of providing liquefaction resistance, degradation characteristics, shear modulus, and the variation in shear modulus with shear deformation. Further, it would be advantageous if such a device could readily enable the quantification of natural phenomena such as liquefaction and degradation.

SUMMARY OF THE INVENTION

In accordance with one preferred embodiment of the present invention a method of testing soil includes the step of inserting a pair of concentric open ended cylinders into the soil to be tested. The inner of the cylinders is excited torsionally, resulting in its rotation through a limited arc of motion about its cylindrical axis. Measures of the resistance of the soil to the excitation of the inner cylinder are then obtained.

In accordance with another preferred embodiment of the present invention, a soil testing probe includes a pair of concentric open ended cylinders. Means are provided for inserting the cylinders open ends first, into a soil sample to be tested. Means apply a torque to the inner of the cylinders which, in response, rotates through a limited arc of motion, within the sample, about the cylindrical axis. Thereafter, means are provided for obtaining measures of the resistance of the soil to the excitation of the inner cylinder.

In accordance with still another preferred embodiment of the present invention, the soil testing probe may include an open ended, cylindrical device and means for inserting the device open end first into the soil sample to be tested. A torque is applied to the device which, in response, rotates through a limited arc of motion within the sample about its cylindrical axis. Thereafter, measuring means are provided for obtaining a measure of the torque applied by the soil in opposition to the rotational motion of the device, by measuring the response of the device to the torque applied by the applying means.

In accordance with still another preferred embodiment of the present invention, a soil testing probe for making tests beneath the soil surface includes a rotatable open ended cylinder insertable into a soil sample to be tested. A concentric shield is positionable in close relationship to the upper portion of the open ended cylinder. Means are provided for rotating the cylinder with respect to the shield.

In accordance with yet another preferred embodiment of the present invention, an apparatus for testing soil includes an open-ended probe insertable open end first into a soil sample to be tested. Means are provided for applying an oscillating force to the probe. Measuring means, give a measure of the resistance of the soil to the motion of the probe in response to the force.

DESCRIPTION OF THE PREFERRED EMBODIMENT

Figure 2:
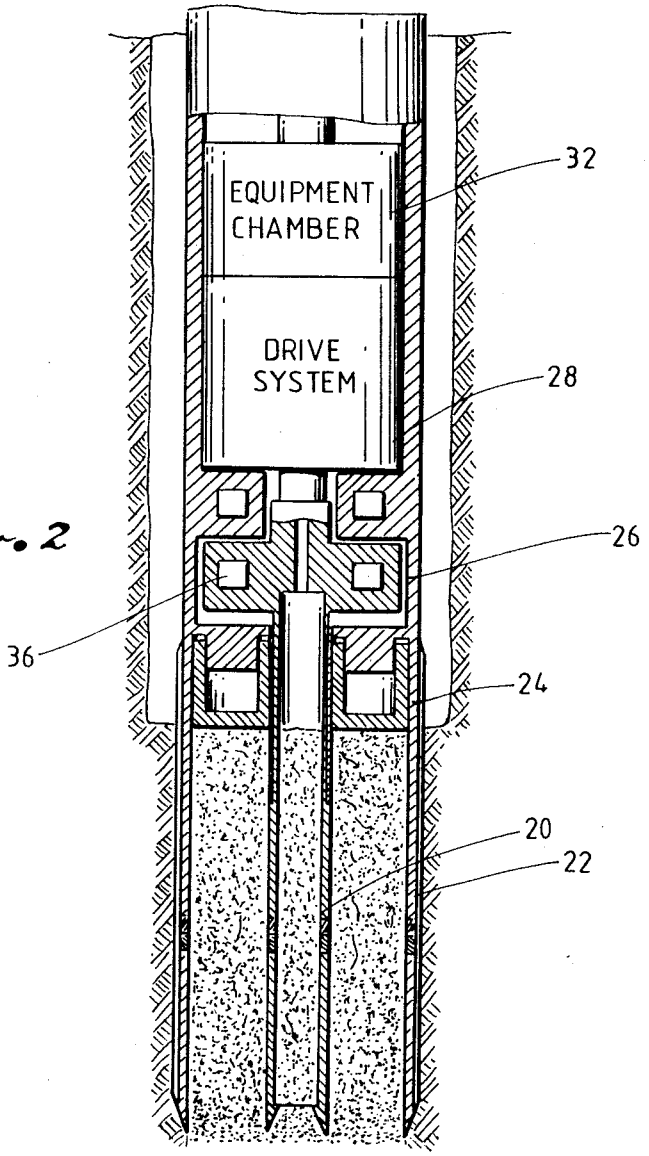
FIG. 2 is an enlarged, schematic cross-sectional view taken generally along the line 2—2 in FIG. 1.
Figure 1:
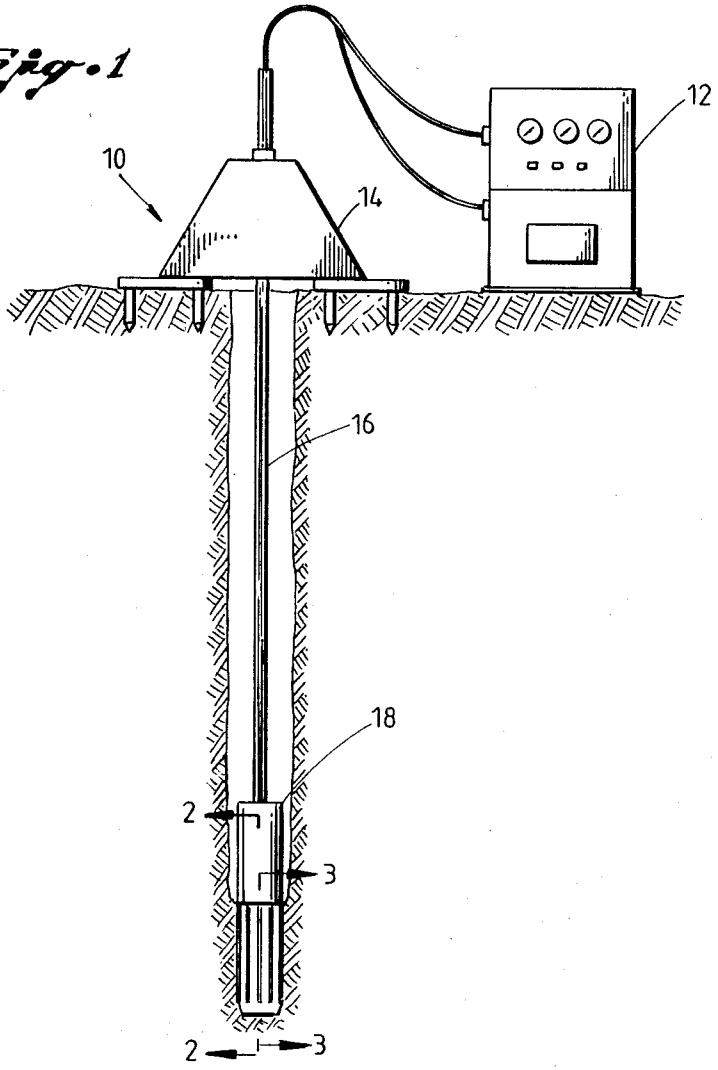
FIG. 1 is a front elevational view of one embodiment of the present invention positioned at the bottom of the bore hole.

Referring to the drawing wherein like reference characters are used for like parts throughout the several views, a soil testing apparatus 10 includes a control, recording, analysis and computation stand 12, a reaction frame 14, a rigid pipe 16, and a probe 18. It should be understood that while the present invention is illustrated as being implemented by a rigid pipe apparatus, the present invention could also be implemented by a flexible wire line within a conventional drill string or in a variety of configurations for non-bore hole applications. The illustrated embodiment of the rigid pipe configuration provides for electrical communications between various sensors within the probe 18 and the stand 12 and further permits a downward or upward displacement to be applied to the probe 18 by way of the reaction frame 14 located at the surface. It should be understood that the displacement force could be applied by other conventional bore hole techniques used with a conventional drill string, and that a displacement force could be applied at the location of the probe, if desired, where a flexible wire line is used, instead of the rigid arrangement illustrated. Other embodiments also provide for electrical communications between various sensors within probe 18 and the stand 12.

As shown in FIG. 2, the probe 18 includes a pair of spaced concentric cylinders 20 and 22, a surface compression unit 24, a sensor section 26, a drive system 28, and an equipment chamber 32, all arranged in a stacked configuration so as to be insertable into a bore hole or other confined space. The equipment chamber 32 may include conventional electronic equipment for providing signal communication between the stand 12, sensor section 26, and drive system 28. The drive system 28 is conveniently a source of controllable torque or controllable angular displacement which is connected to a drive shaft 34 in turn connected to the inner cylinder 20.

In an embodiment using a conventional drill string, a connection system may be used to connect the probe 18 to a drill bit. In this way, the forces needed to penetrate the probe into the ground and to remove it are transmitted through the drill string. This method permits the probe to be used without removal of any part of the drill string. A suitable connection system is shown in U.S. Pat. No 3,709,031, hereby expressly incorporated by reference herein.

Figure 3:
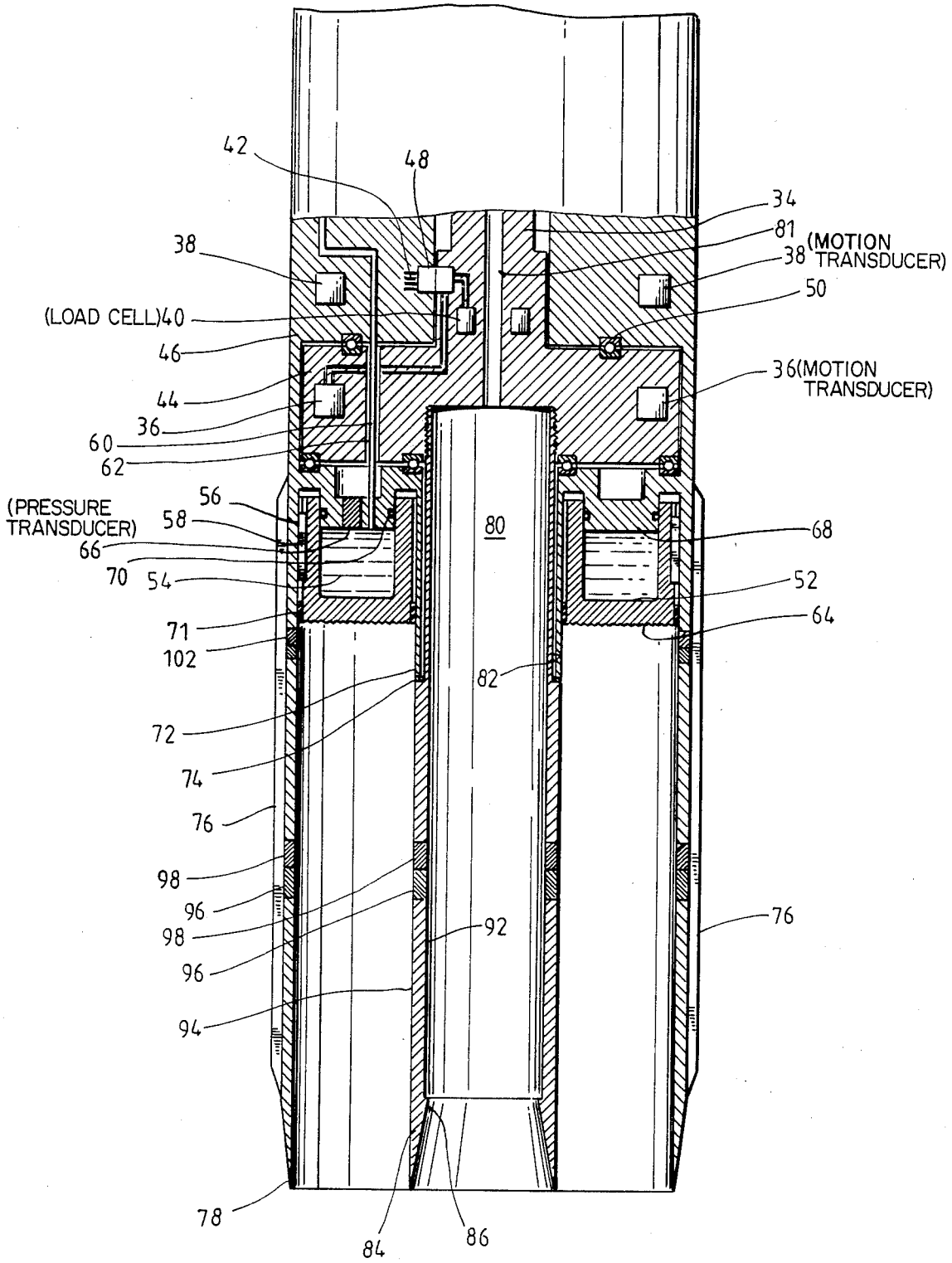
FIG. 3 is a greatly enlarged cross-sectional view taken generally along the line to 3—3 in FIG. 1; and FIG. *4a–4e* is a graphical depiction of typical testing excitations and responses.

As shown in FIG. 3, the sensor section 26 includes a pair of motion transducers 36 and a torsional load cell 40. The torsional load cell 40, which may be implemented by a set of strain gauges, is arranged to measure the torque supplied through the drive shaft 34 to the inner cylinder 20. The load cell 40 may include a pair of sensors of different sensitivities for different testing amplitudes. The rotational response of the cylinder 20 to the excitation provided by the drive system 28 is measured by the motion transducers 36. Advantageously, each transducer 36 includes a pair of sensors, one of which is a low sensitivity sensor for use in connection with high amplitudes and the other is a high sensitivity sensor for use with low amplitudes. Any rotational movement experienced by the relatively stationary outer cylinder 22 is measured by the motion transducers 38.

The electrical lines 42 from the transducers 36 and load cell 40 and other sensors to be described hereinafter, cross between the rotating drive shaft extension 44 and the stationary casing 46. Thus, brushes 48 are provided to insure continuity of electrical communication. In order to insure smooth rotation between rotating and non-rotating parts, bearings 50 are provided.

The surface compression unit 24 includes an annular open topped chamber 52 which is conveniently filled with a fluid, such as oil, indicated as 54. The exterior of the annular chamber 52 includes a key way 56 that rides along a helical key 58 on the casing 46. Thus, movement of the chamber 52 along the central axis of the apparatus 10, is accompanied by the rotation of chamber 52 about the central axis of the apparatus 10. The pressure within the chamber 52 may be adjusted by adding or withdrawing hydraulic fluid through the fluid line 60. Since an annular opening 62 is provided in the extension 44, through which the fluid line 60 passes, fluid communication is always possible from the chamber 52 to the upward extension of the fluid line 60.

In response to the increase of fluid pressure within the chamber 52, the annular chamber 52 rotates about a vertical axis on the helical key 58 by way of its key way 56, threading downwardly towards the free end of the probe 18. Advantageously, the lower face 64 of the chamber 52 is roughened. Further, a pressure transducer 66 is contained in communication with the chamber 52 to provide feedback as to the pressure within the chamber 52. The chamber 52 is sealed by an annular portion 68 of the casing 46 which extends downwardly into the chamber 52 and includes annular seals 70 at abutting surfaces.

A cylindrical shield 72 extends downwardly between the inner cylinder 20 and the surface compression unit 24. Since the cylindrical shield 72 is connected to the casing 46, it is relatively stationary and provides a concentric surface within which the inner cylinder 20 may rotate. A seal 74 is provided at the lower end between the shield 72 and cylinder 20 to prevent the entry of soil and water into the frictionless zone between the cylinder 20 and the shield 72.

The outer cylinder 22 is also fixed to the casing 46 and is therefore relatively stationary. A plurality of outwardly extending vanes 76 are distributed circumferentially about the exterior of the cylinder 22 and extend axially along the length of the apparatus 10 to further immobilize the cylinder 22. The free end 78 of the outer cylinder 22 is sharpened on its exterior side to aid in ground penetration and to minimize the disturbance of the test soil between the two cylinders 20, 22.

Since the inner cylinder 20 may extend upwardly beyond the surface compression unit 24, it may have a greater overall length in comparison to the portion of the outer cylinder 22 contacting the test soil. Particularly, a fluid space 80 may be defined in the upper region of the cylinder 20. The upper extension of the space 80 communicates by way of a tube 81 which extends upwardly through the probe 18 to an exit port (not shown). The upper portion 82 of the inner cylinder 20 is recessed to adapt to the cylindrical shield 72. Thus, the inner cylinder 20 may be rotated by the drive shaft 34 relative to the cylindrical shield 72. The end portions 84 of the inner cylinder 20 include inwardly jutting, inwardly tapered cutting surfaces 86 to aid in ground penetration and also to minimize disturbances to the test soil.

Advantageously, the interior surface 92 of the inner cylinder 20 has a low friction or low modulus lining, such as Teflon. The exterior surface 94 may, if desired, include a roughened surface to increase frictional adherence between the soil and the surface 94.

The inner and outer cylinders 20 and 22 may include total stress sensors 96 and pore water pressure transducers 98 inserted along their length. The sensors 96 and transducers 98 are contoured to preserve the cylindrical geometry. Wires may extend from these transducers upwardly through the casing 46, ultimately connecting to the equipment chamber 32. Advantageously, the sensors 96 and transducers 98 on the cylinders 20 and 22 are arranged in general juxtaposition to one another. In addition, a filter stone 102 may be provided on the upper end of the outer cylinder 22. The stone 102 permits water trapped between the concentric cylinder 22 and the inner cylinder 20 to escape during penetration.

The illustrated embodiment may be used in generally the following fashion. With the probe 18 located just above the bottom of the bore hole, a downward force is applied by conventional techniques through the reaction frame 14 in order to insert the cylinders 20 and 22 into the soil at the bottom of the bore hole. Preferably the insertion of the probe 18 is sufficiently slow to permit water trapped between the inner and outer cylinders 20 and 22 to slowly escape through the stone 102 and for water trapped within the inner cylinder 20 to be expelled through the tube 81.

When the lower face 64 of the surface compression unit 24 begins to contact the upper surface of the bottom of the bore hole, an initial back pressure is sensed by the pressure transducer 66 and is monitored through the computation stand 12. Then, with the probe 18 fully inserted into the sample, as indicated by the pressure sensor 66 associated with the surface compression unit 24, the probe 18 is lifted slightly by the reaction frame 14. This relieves shear stresses and elastic deformations induced in the soil by penetration. The lower surface 64 is then pressed by the surface compression unit 24 against the upper surface of the soil with a twisting motion so that any caps or peaks or other surface irregularities are sheared off and smoothed over. This enables the lower surface 64 to press against an even upper soil surface. The degree of pressure supplied by the surface compression unit 24 may be adjusted by controlling the amount of fluid in the chamber 52. The unit 24 supplies a desired degree of pressure to the upper surface of the soil in order to compensate for the loss of pressure due to the removal of soil from the bore hole.

The inwardly jutting tapered cutting surfaces 86 on the inner cylinder 20 cause the soil, during insertion, to be funneled inwardly into the center region of the inner cylinder 20 and away from the interior surface 92. This is desirable since the friction between the soil and the inner surface 92 should be as low as possible to minimize interaction between them. The freedom of the interior soil is aided by the provision of the fluid space 80 which prevents large confining pressures from developing within this soil.

At this time, one of a variety of excitations may be applied to the inner cylinder 20 and the applied torque, the rotation of the cylinders 20 and 22, and the response of the soil so perturbed may be monitored and recorded by the various sensors 36, 38, 40, 96, 98 and the computation stand 12. By virtue of the shield 72, the excitation is introduced at some depth below the surface of the test soil, thus minimizing effects of disturbances near this surface. In general, three types of limited arc, rotational perturbations of the inner cylinder 20 are advantageously provided by the drive system 28. In a first type of loading, an impulse loading, the force distribution is broadly triangular, quickly increasing to a peak and then quickly dropping to zero. A second type of loading, termed initial condition loading, involves an initial rotary perturbation supplied, for example, from the energy stored within a set of springs (not shown) attached to the drive shaft 34 and released by appropriate triggering action, conveniently from stand 12. The motions that result from these initial perturbations slowly decay as energy is dissipated in the soil. The third type of loading involves a generally oscillating loading such as a sine wave wherein the drive shaft 34 is rotated at a controlled amplitude of torque through a short arc of motion in one direction, reversed and rotated through a comparable arc of motion in the opposite direction. Alternatively, the drive shaft 34 may be rotated at a controlled amplitude of angular displacement. The desired angular displacement is verified by the motion sensors 36 and the torque required to achieve the given angular displacement is measured by the load cell 40 and recorded at the stand 12.

Although the outer cylinder 22 remains relatively stationary during testing, the outer cylinder 22 is important for liquefaction/degradation testing. The phenomena of liquefaction and degradation are induced primarily by the buildup of pore water pressures in the soil during cyclic loading. Without the impermeable boundary that the outer cylinder 22 provides, in the soils of greatest interest, water would be relatively free to flow away from the excited zone of soil near the inner cylinder 20 in response to increases in pore water pressures within that zone. Because of this potentially significant flow of water, pore water pressures may never approach values needed to cause liquefaction or severe degradation. The outer cylinder 22, is also useful in achieving approximately constant volume conditions.

The following sequence of exemplary testing operations may be utilized. Referring to FIG. 4*a*, a low amplitude test may be conducted initially. For example, an impulse torque of low amplitude may be applied to the cylinder 20 so that it rotates through a short arc of motion. The applied torque and response of the cylinder 20, as indicated in FIG. 4*b*, as well as the response of cylinder 22 and the soil are thereafter measured and recorded at the computational stand 12. Next a high amplitude test may be conducted, for example to determine liquefaction resistance. In the liquefaction test, the inner cylinder 20 is excited by a sine wave or other oscillation at high amplitude, as indicated in FIG. 4*c*. The response of the cylinder 20 and the pore water pressure are recorded, as indicated in FIGS. 4*d* and 4*e*, as are the response of cylinder 22 and the total stress. Alternatively, instead of a sine wave loading, an impulse loading at high amplitude may be used to determine the nonlinear shearing stress-strain behavior of the soil sample.

After either high amplitude test is completed, it would generally be undesirable to perform any additional testing since the soil sample will be highly disturbed. However, other types of high amplitude or low amplitude excitations of any of the kinds discussed above may be applied in place of the specific examples described above.

In the case of each test, the torque applied to the drive shaft 34 by the drive system 28 may be determined by the torsional load cell 40 and the rotations of cylinders 20 and 22 measured by the motion sensors 36 or 38. Additional related information may be obtained from the pore water pressure transducers 98, as indicated in FIG. 4*e* and total stress sensors 96.

The properties of the soil tested may be inferred using appropriate analytical models of a test. However, properties may also be inferred using correlations with prior test data, or past observed field performance. When using analytical models, a set of soil properties is assumed for the model. The test is simulated by applying to the model as is appropriate the measured excitation history of the actual test of interest or the initial portion of the measured motion history. The responses are computed for the model and compared to the responses recorded for the test of interest. If the responses measured in the field test compare within acceptable tolerances to the responses computed from the analytical model, then it may be concluded that the assumed properties of the model are a reasonable representation of the properties of the soil in situ. This analytical calculation may be computed automatically on site at the computation stand 12 and the user may be provided with an appropriate indication of general agreement, or the computations may be performed at a remote location at a later time. If agreement within an acceptable tolerance is not obtained, then an appropriate set of new properties is assumed for the model and the test is again simulated. Again, comparisons are made between results from analysis and field tests. This process is repeated until an acceptable comparison is achieved.

The comprehension of suitable analytical methodology is within the means of those skilled in the art. Also, correlation with prior test data may be used to infer properties of interest without using analytical models. The basis and application of appropriate fundamental analytical techniques are set forth, for example, in the article entitled "Torsional Dynamic Response of Solid Media" by Henke and Wylie in the Journal of the Engineering Mechanics Division, Proceedings of the American Society of Civil Engineers, Vol. 108, No. EM1, February 1982, hereby expressly incorporated herein and made a part hereof. Additional relevant information concerning analytical methodology is presented in the articles entitled "Fundamentals of Liquefaction Under Cyclic Loading" by Martin, et al., Journal of the Geotechnical Engineering Division, Proceedings of the American Society of Civil Engineers, Vol. 101, No. GT5, May, 1975; and "Nonlinear Behavior of Soft Clays During Cyclic Loading" by Idriss, et al., Journal of the Geotechnical Engineering Division, Proceedings of the American Society of Civil Engineers, Vol. 104, No. GT12, December, 1978. These articles are expressly incorporated herein and made a part hereof.

A number of variations from the methods and apparatus as described herein are possible. Although the illustrated two cylinder embodiment has a number of important advantages, important achievements may be obtained without the use of two cylinders. In such a case, a single cylinder may be utilized, dispensing with the exterior cylinder. Although such an arrangement may be less than optimal in determining liquefaction resistance and soil degradation characteristics, it may have important applications in determining shear modulus and its variation with shear deformation. Further, although the use of rotary perturbations are believed to be advantageous, other oscillating perturbations, such as vertically reciprocating perturbations, may be useful in certain contexts.

While the present invention has been described with respect to a single preferred embodiment, those skilled in the art will appreciate a number of modifications and variations. It is intended to cover within the appended claims all such variations and modifications as come within the true spirit and scope of the present invention.

What is claimed is:

1. A method of testing soil comprising the steps of:

inserting a pair of concentric open ended cylinders into the soil to be tested;

funneling said soil into the inner of said cylinders so as to space the soil from the inner surface of said inner cylinder;

torsionally exciting the inner of said cylinders by rotating it through a limited arc oscillatory motion about its cylindrical axis; and obtaining a measure of the resistance of the soil to the excitation of the inner cylinder.

2. The method of claim 1 wherein the step of obtaining a measure of the resistance of the soil to the rotation of the inner cylinder includes the step of measuring the motion of said inner cylinder.

3. The method of claim 2 including the step of measuring the torque applied to said inner cylinder.

4. The method of claim 1 including the step of shielding the upper end of said inner cylinder from contact with the soil.

5. The method of claim 1 including the step of first exciting said inner cylinder at a low amplitude and thereafter exciting said cylinder at a high amplitude.

6. The method of claim 1 including the step of oscillating said inner cylinder sufficiently to liquefy the soil.

7. The method of claim 1 including the step of applying a downward pressure to the top of the soil between the inner and outer cylinders.

8. The method of claim 7 wherein said step of applying a pressure to the top of the soil includes the step of applying a smoothing force to the top of the soil while applying said pressure to said soil.

9. The method of claim 1 including the step of measuring the pore water pressure of said soil within said outer cylinder.

10. The method of claim 1 including the step of measuring the total stress of the test soil along the inside of said outer cylinder.

11. The method of claim 1 including the step of applying an impulse torque to said inner cylinder.

12. The method of claim 1 including the step of rotating said inner cylinder from an initial condition.

13. The method of claim 1 including the step of applying an oscillating torque to said inner cylinder.

14. The method of claim 1 including the step of relieving the elastic stresses induced in the test soil during the insertion of said cylinders into the soil.

15. A soil testing probe comprising:

a pair of concentric open ended cylinders, said cylinders being spaced apart so as to define a soil test chamber in the region between said cylinders;

means for inserting said cylinders, open ends first, into a soil sample to be tested, such that soil enters said soil test chamber between said cylinders;

means for applying a torque to the inner of said cylinders, to rotate said inner cylinder through a limited arc of oscillatory motion within said sample, about the cylindrical axis; and means for obtaining a measure of the resistance of the soil within said soil test chamber to the excitation of said cylinder.

16. The probe of claim 15 wherein said measuring means includes means for measuring the motion of said inner cylinder in response to said torsional excitation.

17. The probe of claim 16 wherein said measuring means includes means for measuring the torque applied to said inner cylinder.

18. The probe of claim 15 including a means for applying a downward pressure to the top of the soil between said inner and outer cylinders.

19. The probe of claim 18 including means for measuring the pressure applied by said pressure applying means.

20. The probe of claim 18 wherein said pressure applying means includes means for shearing smooth the upper surface of said soil.

21. The probe of claim 15 including a shield surrounding the upper end of said inner cylinder.

22. The probe of claim 15 wherein said torque applying means includes impulse rotating means.

23. The probe of claim 15 wherein said torque applying means includes means for rotating said cylinder from an initial condition.

24. The probe of claim 15 wherein said torque applying means includes oscillatory rotating means.

25. The probe of claim 15 including means for selectively providing either high amplitude or low amplitude rotation.

26. The probe of claim 15 including an inwardly jutting guide on the lower end of said inner cylinder, arranged to divert the soil away from the inner surfaces of said cylinder.

27. The probe of claim 15 wherein said inner cylinder has a greater axial length than said outer cylinder in order to provide a fluid space at the top of said inner cylinder.

28. A soil testing apparatus comprising:

an open ended, substantially cylindrical device;

means for inserting said device open end first into a soil sample to be tested;

means on the free end of said device for diverting the soil entering the device towards the center of said device;

means for applying a torque to said device to rotate said device through a limited arc of oscillatory motion, within said sample, about the cylindrical axis; and measuring means for obtaining a measure of the torque applied by the soil in opposition to said rotational motion of said device, by measuring the response of said device to the torque applied by said applying means.

29. The apparatus of claim 28 wherein said torque applying means is an impulse rotating means.

30. The apparatus of claim 28 wherein said torque applying means includes means for rotating said device from an initial condition.

31. The apparatus of claim 28 wherein said torque applying means includes means for oscillating said device.

32. The apparatus of claim 28 including means for applying a downward pressure to the top of the soil around said device.

33. A method for testing soil comprising the steps of:

inserting a pair of concentric open ended cylinders into the soil to be tested;

applying a downward pressure to the top of the soil between the inner and outer cylinders;

torsionally exciting the inner of said cylinders by rotating it through a limited arc of oscillatory motion about its cylindrical axis; and obtaining a measure of the resistance of the soil to the excitation of the inner cylinder.

34. The method of claim 33 wherein said step of applying a pressure on the top of the soil includes the step of applying a smoothing force to the top of the soil while applying said pressure to said soil.

35. A soil testing apparatus comprising:

an open ended, substantially cylindrical device;

means for inserting said device open end first into a soil sample to be tested;

means for applying a downward pressure to the top of the soil around said device;

means for applying a torque to said device to rotate said device through a limited arc of oscillatory motion within said sample, about the cylindrical axis; and measuring means for obtaining a measure of the torque applied by the soil in opposition to said rotational motion of said device, by measuring the response of the device to the torque applied by said applying means.

* * * * *